United States Patent [19]

Brooks

[11] 3,981,032

[45] Sept. 21, 1976

[54] NECK PILLOW DEVICE

[75] Inventor: Susie C. Brooks, Denver, Colo.

[73] Assignee: The Raymond Lee Organization, Inc., New York, N.Y. ; a part interest

[22] Filed: Jan. 23, 1976

[21] Appl. No.: 651,928

[52] U.S. Cl. ..... 5/338; 128/33

[51] Int. Cl.[2] ..... A61H 1/00; A47G 9/00

[58] Field of Search ..... 5/338, 327 R, 327 B, 5/341; 128/1 C, 33

[56] References Cited

UNITED STATES PATENTS

| | | | |
|---|---|---|---|
| 1,385,355 | 7/1921 | Banks | 5/338 |
| 1,386,652 | 8/1921 | Patton | 5/338 |
| 2,792,830 | 5/1957 | Dacey | 128/33 X |
| 2,850,009 | 9/1958 | McElwee | 128/33 X |
| 3,103,219 | 9/1963 | Chadner | 128/1 C X |
| 3,601,121 | 8/1971 | Roberts | 128/33 |
| 3,897,777 | 8/1975 | Morrison | 5/327 X |

*Primary Examiner*—Donald A. Griffin
*Attorney, Agent, or Firm*—Daniel Jay Tick

[57] ABSTRACT

A pair of vibrators for vibrating the neck of a person resting on a neck pillow are mounted on such pillow in mutually spaced relation each on a corresponding side of the neck of the person. A pair of face pillows are mounted on the neck pillow for supporting the face of a person lying on his side on the neck pillow. Each of the face pillows is positioned alongside a corresponding one of the vibrators with the vibrators interposed between the face pillows.

3 Claims, 4 Drawing Figures

NECK PILLOW DEVICE

DESCRIPTION OF THE INVENTION

The present invention relates to a neck pillow device. More particularly, the invention relates to a neck pillow device for supporting the neck of a reclining person.

Objects of the invention are to provide a neck pillow device of simple structure, which is inexpensive in manufacture, used with facility, convenience and safety, and functions efficiently, effectively and reliably to selectively vibrate and heat the neck and shoulders of a user as well as to provide face resting pillows for a user lying on his side.

In order that the invention may be readily carried into effect, it will now be described with reference to the accompanying drawing, wherein.

The neck pillow device of the invention is for supporting the neck of a reclining person.

The neck pillow device of the invention comprises a neck pillow 1.

Figure 1:
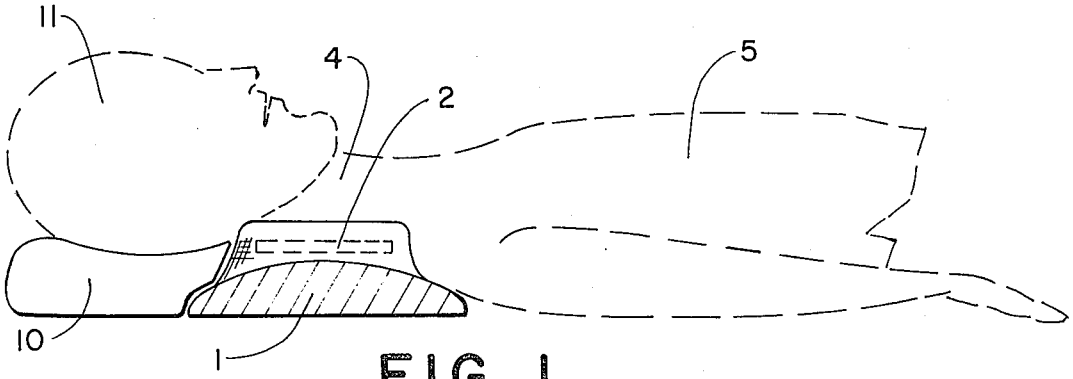
FIG. 1 is a view, partly in section, of an embodiment of the neck pillow device of the invention in use.

A pair of vibrators 2 and 3, of any suitable known type, vibrate the neck 4 of a person 5 resting on the neck pillow 1 (FIG. 1). The vibrators 2 and 3 are mounted on the neck pillow 1 in mutually spaced relation, each on a corresponding side of the neck of the person 5.

A pair of face pillows 6 and 7 (FIGS. 2 and 3) are mounted on the neck pillow 1 for supporting the face of the person 5 when he lies on his side on the neck pillow. Each of the face pillows 6 and 7 is positioned alongside a corresponding one of the vibrators 2 and 3 with the vibrators interposed between the face pillows.

The neck pillow 1 has a pair of spaced opposite substantially parallel edges 8 and 9 (FIG. 2) bordering the vibrators 2 and 3 and the face pillows 6 and 7. A head pillow 10 is removably affixed to the edge 9 of the neck pillow 1 for supporting the head 11 (FIG. 1) of the person 5. The head pillow 11 may be affixed to the neck pillow 1 by any suitable means such as, for example, a zipper 12 extending along the edge 9.

Figure 2:
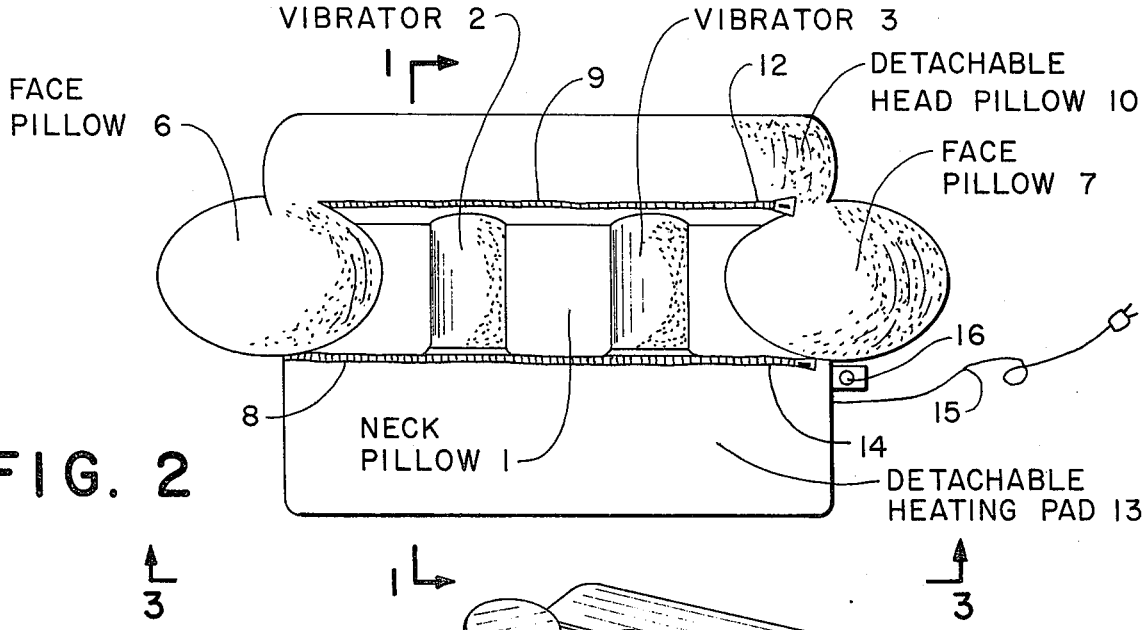
FIG. 2 is a top plan of an embodiment of the neck pillow device of the invention.
Figure 4:
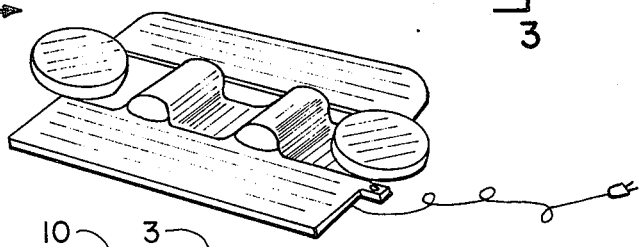
FIG. 4 is a perspective view of the neck pillow device of the invention.
Figure 3:
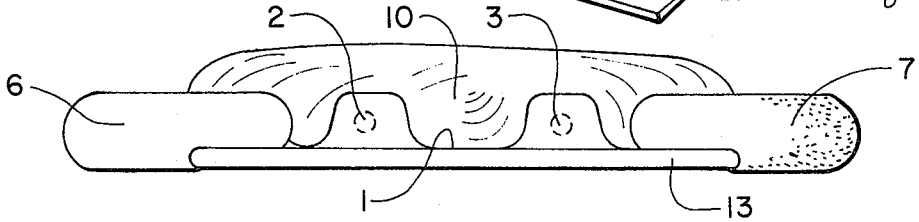
FIG. 3 is a view, taken along the lines III—III, of FIG. 2.

A heating pad 13 (FIGS. 2 and 3) is removably affixed to the edge 8 of the neck pillow 1 and functions to heat the shoulder area of the person 5. The heating pad 13 may be affixed to the neck pillow 1 by any suitable means such as, for example, a zipper 14 extending along the edge 8. The heating pad 13 is energized by a suitable source of electrical energy via electrical conductors 15 and is selectively controlled via a switch 16 (FIG. 2).

While the invention has been described by means of a specific example and in a specific embodiment, I do not wish to be limited thereto, for obvious modifications will occur to those skilled in the art without departing from the spirit and scope of the invention.

I claim:

1. A neck pillow device for supporting the neck of a reclining person, said neck pillow device comprising a neck pillow;

a pair of vibrators for vibrating the neck of a person resting on the neck pillow, said vibrators being mounted on the neck pillow in mutually spaced relation each on a corresponding side of the neck of the person; and a pair of face pillows mounted on the neck pillow for supporting the face of a person lying on his side on the neck pillow, each of the face pillows being positioned alongside a corresponding one of the vibrators with said vibrators interposed between said face pillows.

2. A neck pillow device as claimed in claim 1, wherein the neck pillow has a pair of spaced opposite substantially parallel edges bordering the vibrators and the face pillows, and further comprising a head pillow removably affixed to one edge of the neck pillow for supporting the head of the person.

3. A neck pillow device as claimed in claim 1, further comprising a heating pad removably affixed to the opposite edge of the neck pillow for heating the shoulder area of the person.

* * * * *